US005881660A

United States Patent [19]

Hiramatsu et al.

[11] Patent Number: 5,881,660

[45] Date of Patent: Mar. 16, 1999

[54] NEEDLE THREAD CHANGING DEVICE OF SEWING MACHINE

[75] Inventors: Tooru Hiramatsu, Chofu; Nobuo Yano, Omiya, both of Japan

[73] Assignee: Juki Corporation, Tokyo, Japan

[21] Appl. No.: 832,628

[22] Filed: Apr. 4, 1997

[30] Foreign Application Priority Data

Oct. 4, 1996 [JP] Japan ..... 8-088420

[51] Int. Cl.[6] ..... D05B 25/00

[52] U.S. Cl. ..... 112/302

[58] Field of Search ..... 112/302, 253, 112/285, 286, 163, 167, 168, 80.7; 289/1.5, 2, 11, 17, 18.1

[56] References Cited

U.S. PATENT DOCUMENTS 3,067,704 12/1962 Pedersen ..... 112/302 X
5,269,244 12/1993 Cataletto et al. .
5,682,830 11/1997 Katou et al. ..... 112/302 X

FOREIGN PATENT DOCUMENTS 0643005 12/1993 European Pat. Off. .
58-181384 12/1983 Japan .
3057092 3/1988 Japan ..... 112/302
755274 12/1989 Japan .

*Primary Examiner*—Ismael Izaguirre
*Attorney, Agent, or Firm*—Morgan & Finnegan LLP

[57] ABSTRACT

A needle thread changing device of a sewing machine, comprises: a first thread end holding section for holding thread end portions of plurality threads respectively drawn from a plurality of spools; a thread cutting section for cutting a thread being currently used while selectively drawn from the first thread end holding section; a second thread end holding section for holding an end portion of the thread of a needle side cut by the thread cutting section; a thread selecting section for selecting a changing thread from the plurality of threads held by the first thread end holding section; a thread end portion moving section for moving an end portion of the thread selected by the thread selecting section to a predetermined knotting position; and a knotting section for connecting the end portion of the thread thus selected to the end portion of the thread currently used held by the second thread end holding section at the knotting position after the thread thus selected has been moved to the predetermined knotting position.

7 Claims, 10 Drawing Sheets

19
21
ROM
RAM
18
THREAD CHANGE CONTROL SECTION (CPU)
606a
MOTOR DRIVER
606
16
THREAD CHANGE STARTING SIGNAL
THREAD SELECTING SIGNAL
SEWING MACHINE CONTROL UNIT
17
SEWING DATA FLOPPY DISK
SV1
SV2
SV3
SV4
SV5
SV6
901
902
111
122
123
VACUUM GENERATOR
125

NEEDLE THREAD CHANGING DEVICE OF SEWING MACHINE

BACKGROUND OF THE INVENTION

The invention relates to a needle thread changing device of a sewing machine that can automatically change a needle thread for another thread having different colors, kinds or the like.

A needle thread changing device of a sewing machine in which a thread currently using is knotted with a thread to be changed is disclosed in Examined Japanese Patent Publication No. Hei. 3-5834.

In the technology disclosed in the aforementioned publication, mechanisms for respectively holding a plurality of spools is arranged on a rotating table unit. Further, a predetermined actuator for clamping a thread end portion drawn from a spool is arranged for each holding mechanism. A single needle thread is selected from the plurality of spools and fed to the needle.

A currently used needle thread (changed thread) is changed for a new thread (changing thread) by cutting the currently used needle thread at a predetermined position on the head portion of the sewing machine, clamping the end portion of the currently used needle thread on the preceding thread side (the "preceding thread side" meaning a side of the cut changed thread to be knotted with a changing thread) with the predetermined actuator, and clamping the end portion of the changing thread on the spool side with the actuator arranged for the corresponding-holding mechanism. Then, the table unit is rotated to move the spool of the changing thread to a position confronting the head portion of the sewing machine, and the spool of the changing thread is moved toward the head portion of the sewing machine from the table unit together with the spool holding mechanism. Then, the end portion of the changing thread clamped by the actuator in the holding mechanism is set to the predetermined position (thread cutting position), and a knotting unit is driven to connect the end portion of the changing thread to the preceding thread.

However, the following problems have been addressed in the aforementioned conventional technology.

That is, the aforementioned technology requires that not only the table unit be rotated but also the spool of a changing thread be moved between the table unit and the head portion of the sewing machine together with the corresponding holding mechanism every time threads are changed. The aforementioned technology further requires a thread end portion clamping means for each spool.

For this reason, there exist problems that thread changing speed is slow and that sewing efficiency is low. In addition, since the mechanisms are complicated, the number of parts is increased, which in turn increases not only the structure of the device but also the cost of manufacture.

Therefore, an object of the invention is to provide a needle thread changing device of a sewing machine that can not only implement high sewing efficiency but also downsize the structure of the device and reduce the cost of manufacture by allowing threads to be changed without moving spools.

Another object of the invention is to provide a needle thread changing device of a sewing machine that can downsize the structure of the device and reduce the cost of manufacture by dispensing with a thread end portion clamping means per spool.

Still another object of the invention is to provide a needle thread changing device of a sewing machine that can facilitate the cleaning of the waste threads produced by the thread connecting operation.

According to a first aspect of the invention, there is provided a needle thread changing device of a sewing machine, comprising: a first thread end holding section for holding thread end portions of plurality threads respectively drawn from a plurality of spools; a thread cutting section for cutting a thread being currently used while selectively drawn from the first thread end holding section; a second thread end holding section for holding an end portion of the thread of a needle side cut by the thread cutting section; a thread selecting section for selecting a changing thread from the plurality of threads held by the first thread end holding section; a thread end portion moving section for moving an end portion of the thread selected by the thread selecting section to a predetermined knotting position; and a knotting section for connecting the end portion of the thread thus selected to the end portion of the thread currently used held by the second thread end holding section at the knotting position after the thread thus selected has been moved to the predetermined knotting position.

According to the needle thread changing device of a sewing machine of the first aspect, threads are no longer changed by moving the spool of a changing thread as in the conventional example. That is, a plurality of thread end portions respectively drawn from a plurality of spools are held by the first thread end portion holding section; a changing thread is selected from the threads held by the first thread end portion holding section; and the end portion of the selected thread is moved to a predetermined knotting position. Compared with the conventional example in which the spool itself is moved, the operation of moving the end portion of the thread drawn from each spool to a knotting position can be performed with a simpler means and within a shorter period of time.

Therefore, according to the needle thread changing device of a sewing machine, not only high sewing efficiency can be implemented but also the device structure can be downsized and the cost of manufacture can be reduced by allowing threads to be changed without moving spools.

According to a second aspect of the invention, there is provided the needle thread changing device of a sewing machine of the first aspect, wherein the first thread end holding section holds the thread end portions of the threads so as to hang down in a row.

According to the needle thread changing device of a sewing machine of the second aspect, the first thread end portion holding section holds the respective thread end portions drawn from the plurality of spools so as to hang down in a row. Therefore, there is no inconvenience in positioning the thread end portions for knotting even if there is no thread end portion clamping means per holding mechanism that holds a spool as in the conventional example.

Therefore, according to the needle thread changing device of a sewing machine of the second aspect, the device structure can be downsized and the cost of manufacture can be reduced by dispensing with a thread end portion clamping means per spool, in addition to the operation and advantages provided by the needle thread changing device of a sewing machine of the first aspect.

According to a third aspect of the invention, there is provided the needle thread changing device of a sewing machine described above, further comprising: a remaining thread discharging section for discharging thread portions remaining after the threads have been connected.

In the needle thread changing device of a sewing machine of the third aspect, the remaining thread discharging section that discharges thread portions remaining after the threads have been connected to a predetermined place is included. Therefore, the operation of cleaning the waste threads produced after the threads have been connected can be facilitated, in addition to the operation and advantages provided by the needle thread changing device of a sewing machine described above.

According to a fourth aspect of the invention, there is provided a thread changing device comprising; a sewing machine having a needle; a plurality of thread winding members, each having a thread; a first holding member for holding the respective threads in such a manner that the threads respectively paid off from the thread winding members are arranged along thread passages and are maintained so as to be substantially in parallel with one another; a selecting means for selecting a thread to be fed to the needle while moving the first holding means in a direction perpendicular to the thread passages; a thread cutting member being arranged closer to the needle than the selecting means along the thread passages and being movable to an operating position and to a return position, the operating position being a position at which the thread cutting member picks up a currently selected thread while crossing the thread passage of the currently selected thread, the return position being a position toward which the thread cutting member moves away from the operating position so that the thread cutting member draws near and cuts the picked up thread and holds an end portion of a cut thread portion extending to the needle; a pickup member being movable to an operating position and to a return position, the operating position being a position at which the pickup member picks up an end portion of a newly selected thread while crossing the passage of the newly selected thread, the return position being a position at which the pickup member draws near and holds the picked up end portion of the newly selected thread so that the pickup member holds the newly selected thread at a predetermined distance from the currently selected thread held by the thread cutting member with one of the threads up and the other down; and a knotting unit being parallelly movable to an operating position and to a standby position, the operating position being a position at which the knotting unit advances into the distance between the currently selected thread held by the thread cutting member and the newly selected thread held by the pickup member, the standby position being a position toward which the knotting unit moves away from the operating position, the knotting unit also knotting both threads at the operating position.

In the fourth aspect, advantages similar to those of the first aspect can be obtained in a thread changing device that connects a currently used thread to a changing thread by knotting threads in such a way as described in the invention.

According to a fifth aspect of the invention, there is provided the thread changing device of the fourth aspect, wherein the thread cutting member and the pickup member are located with one up and the other down, and the thread knotting unit is arranged so as to be distanced therefrom in a horizontal direction.

In the fifth aspect of the invention, the knotting unit can be moved linearly in the horizontal directions, which in turn allows advantages similar to those of the first aspect to be obtained.

According to a sixth aspect of the invention, there is provided the thread changing device of the fourth aspect, wherein the moving direction of the selecting means is parallel with the moving directions of the thread knotting unit.

In the sixth aspect, advantages similar to those of the fifth aspect can be obtained.

According to a seventh aspect of the invention, there is provided the thread changing device of the fifth aspect, wherein discharge members are arranged below the operating position of the thread cutting member and the operating position of the pickup member, the discharge members serving to scrap cut waste thread portions.

In the seventh aspect, advantages similar to those of the third aspect can be obtained.

DETAILED DESCRIPTION OF THE PREFERRED EMBODIMENTS

First, the construction of the invention will be described.

Figure 1:
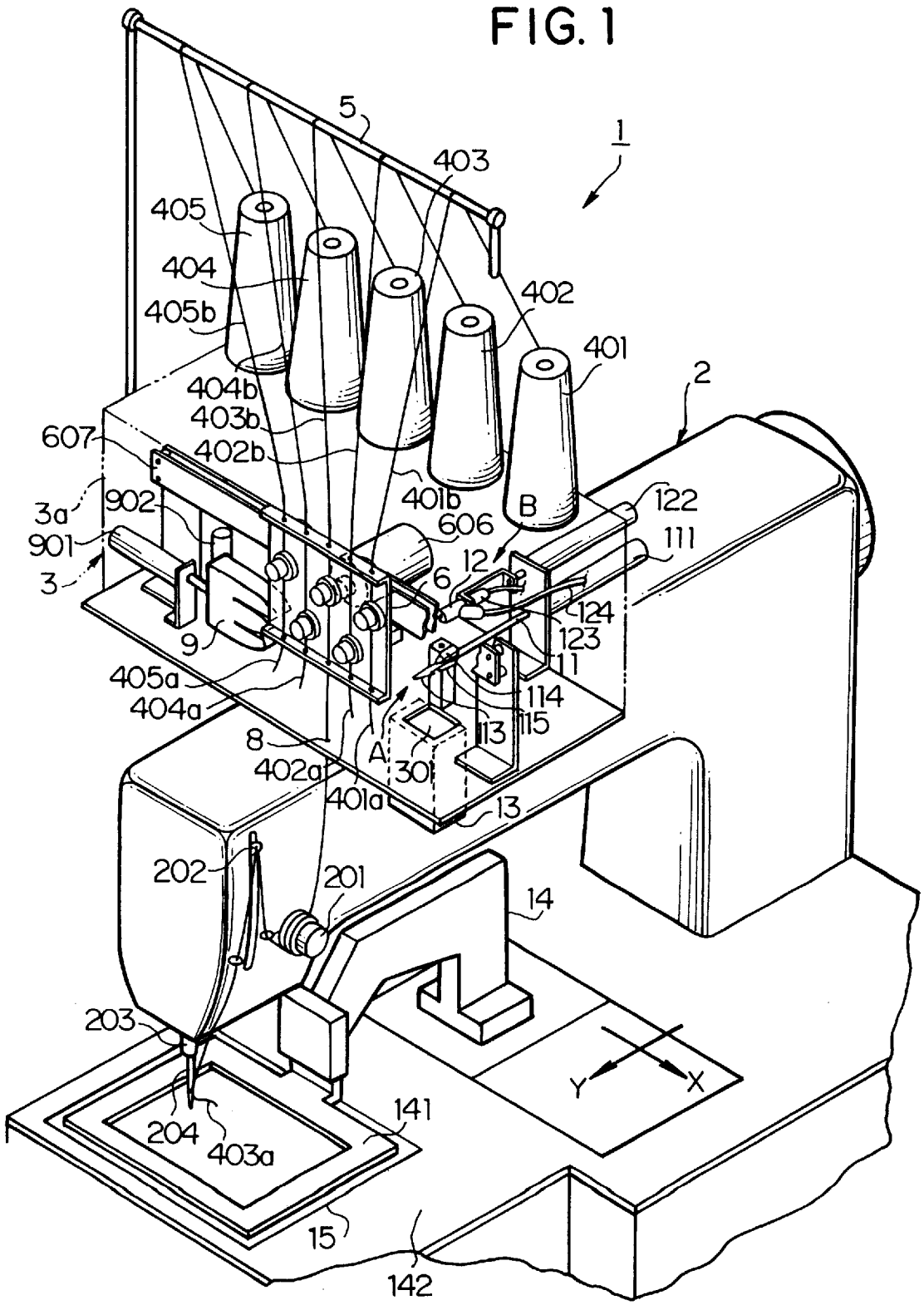
FIG. 1 is a perspective view of an automatic sewing machine according to the invention.

FIG. 1 is a perspective view of an automatic sewing machine 1, which is one embodiment of the invention.

The automatic sewing machine 1 has a needle thread changing device (electronic box) 3 on the head portion 2 of the sewing machine. Spools 401 to 405 for needle threads of different colors are arranged and held in a row on the electronic box 3. A tension thread guide 5 is also arranged on the electronic box 3, so that the thread end portions 401*a* to 405*a* of the threads 401*b* to 405*b* respectively drawn from the spools 401 to 405 hang down onto a front side surface 3*a* of the electronic box 3 while inserted into the tension thread guide 5.

Figure 2:
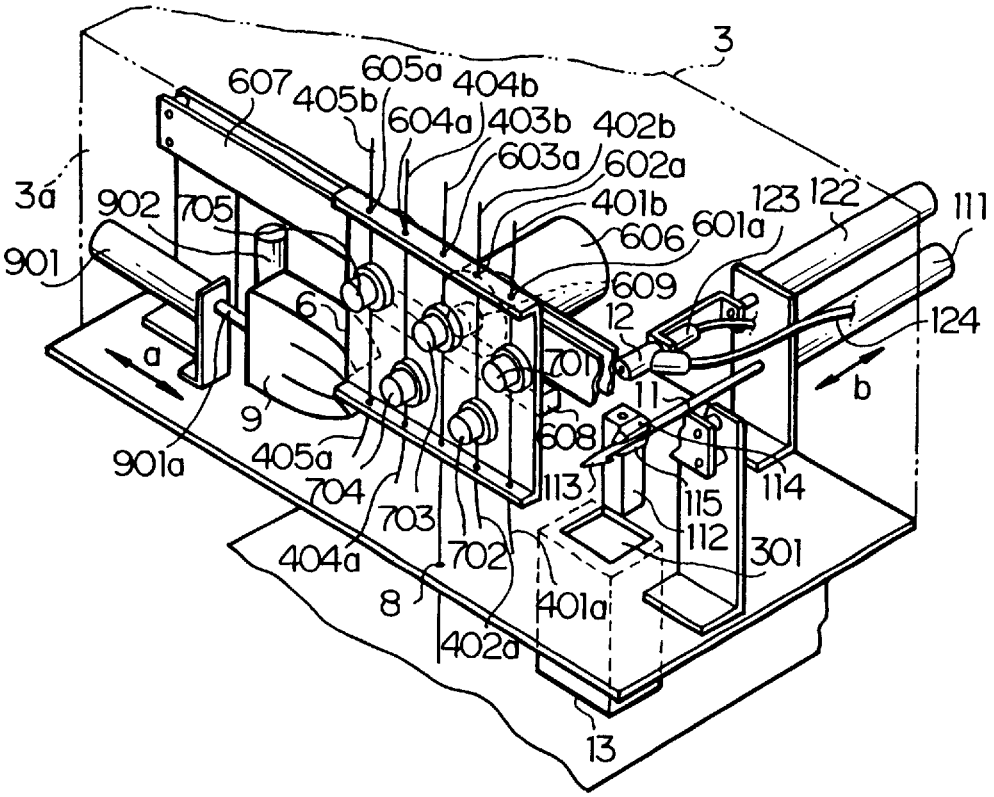
FIG. 2 is a perspective view of a needle thread changing device of the automatic sewing machine of the invention.

As shown in FIG. 2, a tension bracket 6 is arranged on the front side surface 3*a* of the electronic box 3. The tension bracket 6 holds the respective thread end portions 401*a* to 405*a*. Holes 601*a* to 605*a* are formed in an upper end edge of the tension bracket 6, and holes 601*b* to 605*b* are formed in a lower end edge of the tension bracket 6 so as to correspond to the holes 601*a* to 605*a* in the vertical direction. The thread end portions 401*a* to 405*a* are inserted into the vertically confronting holes 601*a* to 605*a* and 601*b* to 605*b*. As a result, the threads 401*b* to 405*b* have the end portions thereof 401*a* to 405*a* arranged so as to hang down from the tension bracket 6 in a row. Tension blocks 701 to 705 are arranged at the intermediate positions between the holes 601*a* to 605*a* and the holes 601*b* to 605*b* of the threads 401*b* to 405*b*. A hole 8 that allows a needle thread for the needle 204 of the sewing machine to be inserted thereinto is formed in a portion extending than the front side surface 3*a* of the bottom of the electronic box 3.

The tension bracket 6 is supported so as to be movable in the directions indicated by the arrows a with respect to a rail 607 fixed to the front side surface 3*a*. The tension bracket 6 also has a rack 608 fixed to the rear portion thereof along the rail 607. A pulse motor 606 that is fixed within the electronic box 3 and a pinion 609 that is driven by the pulse motor 606 and is projected frontward from the electronic box 3 are disposed. The pinion 609 engages with the rack 608. The tension bracket 6 moves in horizontal directions (in the directions indicated by the arrows a) through the rack 608 and the pinion 609 while driven by the pulse motor 606, and positions a desired one of the thread ends 401*a* to 405*a* on the hole 8.

As a knotter 9, a knotter, which is the TYPE SSAK manufactured by ASAHI SEIMITSU CO., LTD. is used. The knotter 9 is fixed to an end of a rod 901*a* of an air cylinder 901, and moves in the directions indicated by the arrows a. Further, an air cylinder 902 is disposed on the knotter 9, and a predetermined drive lever is attached to the plunger of the air cylinder 902, the drive lever allowing the knotter 9 to perform the knotting operation.

Figure 13:
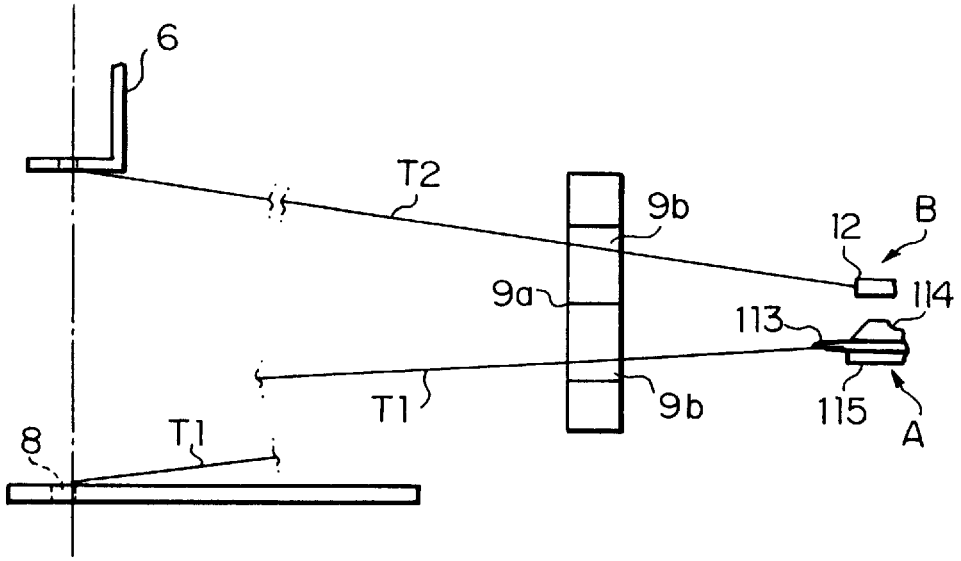
FIG. 13 is a front view showing a positional relationship between a knotter, a thread holding unit, and a thread cut and holding unit of the invention.

As shown in FIG. 13, the knotter 9 has a separating section 9*a* and guide sections 9*b*, 9*b*. The separating section 9*a* separates two horizontally extending threads from each other. The guide sections 9*b*, 9*b* guide the individual separated threads to the knotting position. The guide sections 9*b*, 9*b* are arranged above and below the separating section 9*a*. The knotter 9 manufactured by ASAHI SEIMITSU is designed to knot the guided threads and to cut away superfluous thread portions.

A thread cut and hold unit A is implemented by utilizing a thread cutting unit of a sewing machine disclosed in the specification and drawings of Unexamined Japanese Utility Model Publication No. Sho. 58-181384. A thread pickup 11 has the base end portion thereof connected to a rod of an air cylinder 111, and is moved in horizontal directions (in the directions indicated by the arrows b) perpendicular to the knotter 9 moving directions by the drive of this air cylinder 111. This thread pickup 11 is supported by a support bench 112 fixed within the electronic box 3, and has on the front end thereof an arrowhead 113 for picking up and pulling a needle thread. Further, on the support bench 112 are a thread cutter 114 that cuts the needle thread in cooperation with the arrowhead 113 and a thread retainer 115 that holds the end portion of a cut thread portion extending to the needle together with the arrowhead 113.

A thread hold unit B is implemented by utilizing a hold unit disclosed in Examined Japanese Patent Publication No. Hei. 7-55274. A thread clamp 12 is arranged on a rod of an air cylinder 122, and is moved in the directions indicated by the arrows b by the drive of this air cylinder 122. The thread clamp 12 has on the front end thereof a sucking port that sucks air through a tube 124. A thread end portion is sucked by the thread clamp 12. Further, an air cylinder 123 is arranged, and a clamp section (not shown) that clamps the sucked thread end portion by the drive of this air cylinder 123 is also arranged.

An opening 301 is formed in the bottom portion of the electronic box 3 on the arrowhead 113 side. A waste thread container 13 is arranged below the opening.

Any one of the threads 401*b* to 405*b* hanging down while inserted into the hole 8 (the thread 403*b* in the example shown in FIG. 1) is inserted into a thread tension block 201 and a thread take-up lever 202, and threaded into the hole of a needle 204 fixed to the front end of a needle bar 203.

As shown in FIG. 1, a feeder 14 has a pressure foot 141 arranged, and moves over a predetermined movable table in X-Y directions based on sewing pattern data included in predetermined sewing data while clamping a work 15 to be sewn. Reference numeral 142 denotes a throat plate.

A configuration of a control system of the automatic sewing machine 1 will be described next.

Figure 3:
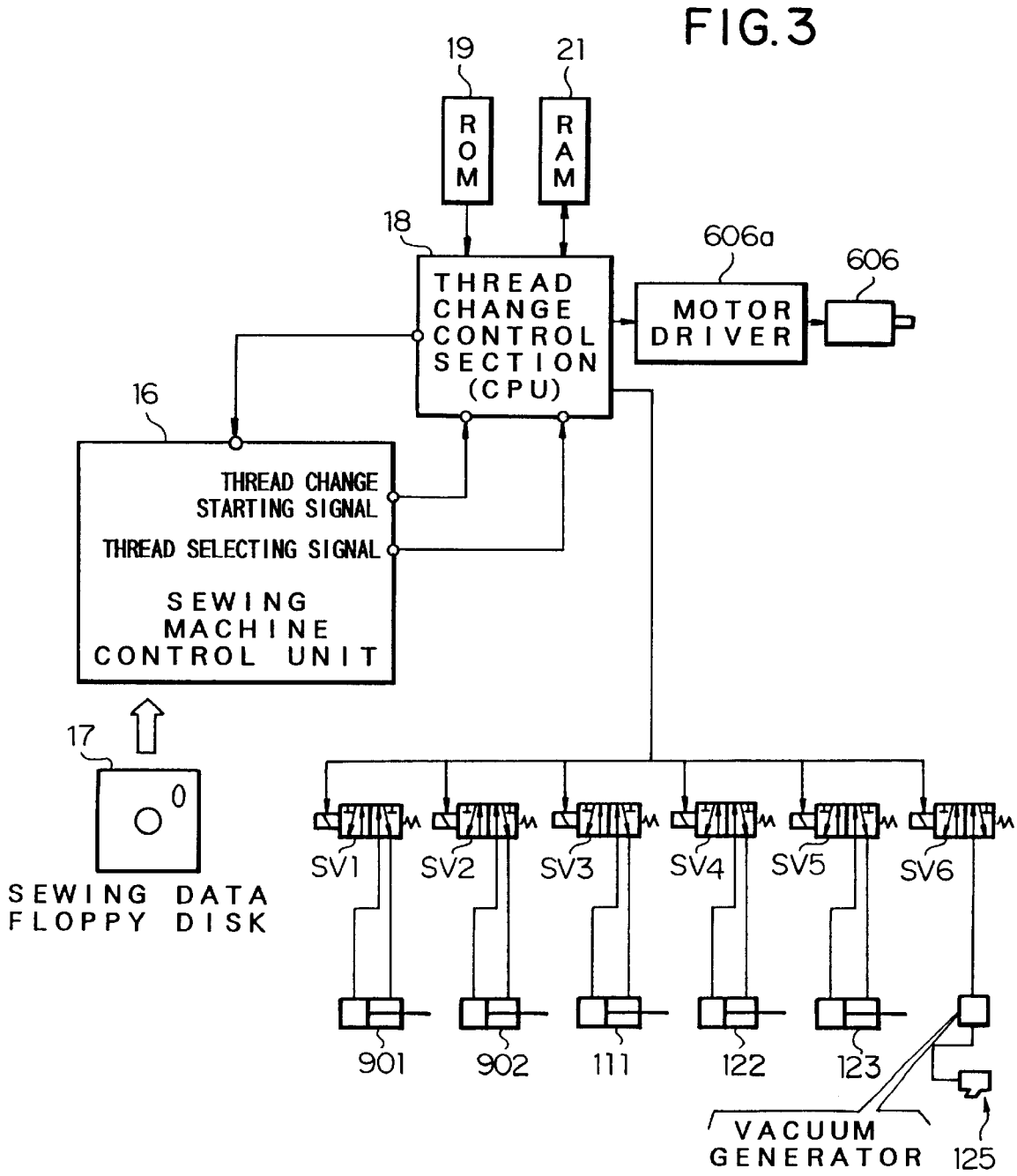
FIG. 3 is a block diagram illustrative of a configuration of a control system of the automatic sewing machine of the invention.

FIG. 3 is a block diagram illustrative of a control system of the needle thread changing device 3 of the automatic sewing machine 1.

As shown in FIG. 3, the electronic box (needle thread changing device) 3 has therein a sewing machine control unit 16. This sewing machine controlling unit has a predetermined floppy disk drive and controls respective parts of the sewing machine 1 to implement predetermined pattern sewing operations based on predetermined sewing data stored in a floppy disk 17. That is, the sewing machine controlling unit 16 controls the drive of the feeder 14, the feed lifting rock shaft (not shown) of the sewing machine 1 by the sewing motor, and the like based on the predetermined sewing data stored in the floppy disk 17, and locates the needle while driving the feeder 14 in the X-Y directions, so that a predetermined pattern sewing operation can be performed.

The sewing data includes: sewing pattern data which are coordinate data for locating the needle while driving the feeder 14 in the X-Y directions; and thread change control data for outputting a predetermined thread change start signal and a thread specification signal to a thread change control section (CPU) 18. Since other configurational aspects of the sewing machine control unit 16 are the same as those of the conventional automatic sewing machine, detailed descriptions thereof will be omitted.

A ROM 19 and a RAM 21 connect to the thread change control section (CPU) 18. The ROM 19 stores a predetermined control program for controlling the respective parts to implement needle thread change, and the like.

The thread change control section 18 applies a control signal to a motor driver 606*a* that drives the motor 606, and controls also solenoid valves SV1 to SV6 by applying control signals thereto. The solenoid valves SV1 to SV5 supplies air to the air cylinders 901, 902, 111, 122, and 123. Further, the solenoid valve SV6 is arranged on a valve 124 that has the thread clamp 12 and the vacuum generator 125 connected thereto, the vacuum generator 125 sucking the air within the thread clamp 12. The solenoid valve SV6 opens and closes the valve 124. Further, the thread change control section 18 feeds a predetermined thread change end signal to the sewing machine control unit 16.

The operation will be described next.

Figure 4:
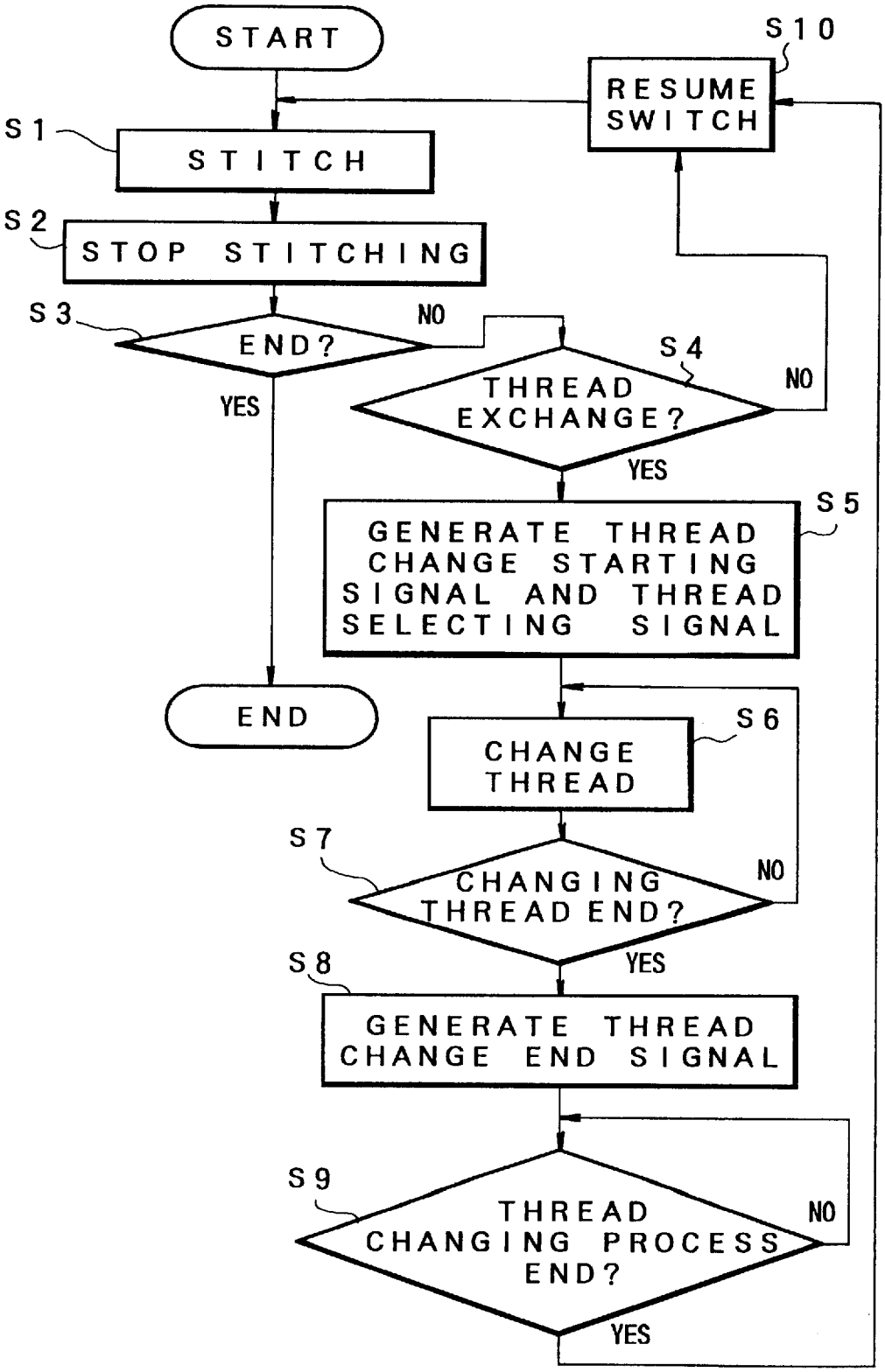
FIG. 4 is a flowchart illustrative of an operation of the automatic sewing machine of the invention.

FIG. 4 is a flowchart illustrative of the operation of the automatic sewing machine 1.

First, a predetermined pattern sewing operation is performed by the sewing machine control unit 16 with the sewing data read on a single stitch basis (Step S1). When the feed lifting rock shaft and the feeder 14 stop to thereby stop the sewing operation (Step S2) after the pattern sewing operation has been performed for a predetermined section, the sewing operation is ended if such stop is brought about by the end of the whole sewing process, and if not, Step S4 will be executed (Step S3). In Step S4, it is judged whether or not such stop is made because a thread change is required, based on the thread change control data, and if the result of judgment is affirmative, Step S5 will be executed, and if the result of judgment is negative, Step S10 will be executed. In Step S10, the sewing operation can be resumed (Step S1) by manually operating a resume start switch.

In Step S5, a thread change start signal and a thread specification signal from the control unit 16 are applied to the thread change control section (CPU) 18. The thread change start signal gives the CPU 18 a command for starting a thread change operation, and the thread specification signal specifies a changing thread to the CPU 18. Upon reception of these signals by the CPU 18, the thread change operation, which will be described later, is performed by the control program stored in the ROM 19 (Step S6). When the thread change operation has been ended (Step S7), the CPU 18 applies a thread change end signal to the control unit 16. When the changing thread after the thread change operation (succeeding thread) is drawn up to the tip of the needle either manually or automatically after this thread change end signal has been received by the control unit 16 (thread change processing end), the sewing operation with the new, succeeding thread (Step S1) is ready to be resumed by operating the resume start switch manually (Step S10).

Then, the thread change operation (Step S6) will be described.

FIGS. 5 to 11 are perspective views illustrative of the thread change operation performed by the automatic sewing machine 1 in sequence.

Figure 5:
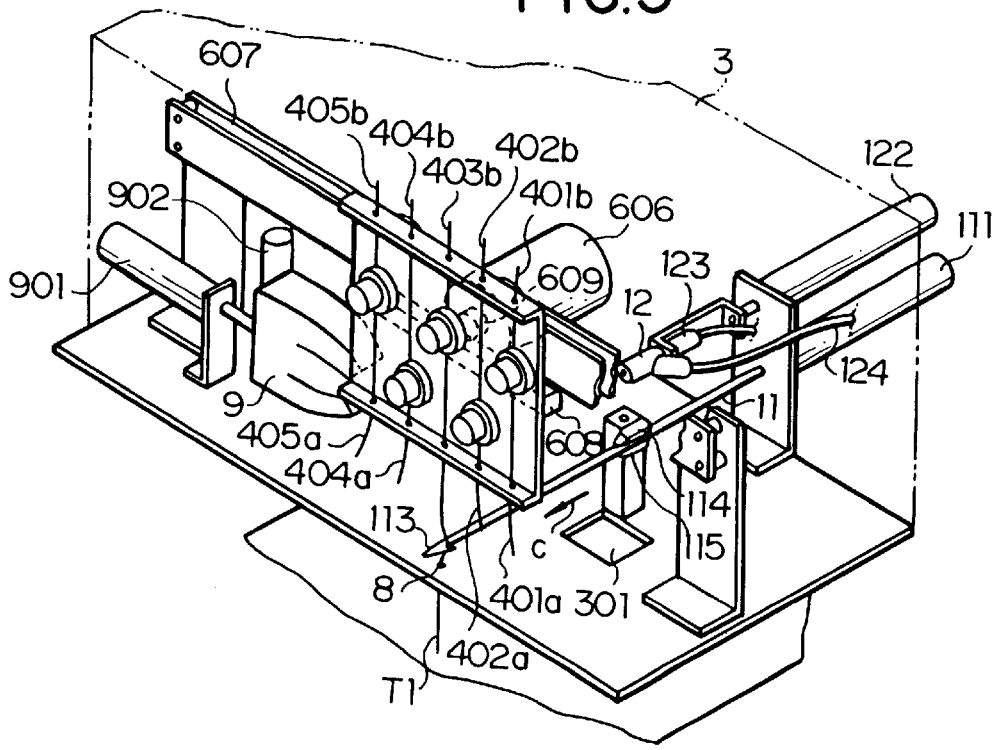
FIG. 5 is a perspective view illustrative of the operation of changing needle threads of the automatic sewing machine of the invention.

First, as shown in FIG. 5, a control signal is applied to the solenoid valve SV3 (see FIG. 3) from the CPU 18, so that the cylinder 111 is driven and the thread pickup 11 moves to the direction indicated by an arrow c. As a result, a currently using thread T1 (the thread 403*b* in this example) is picked up by the arrowhead 113 at the tail end of the thread pickup 11.

Figure 6:
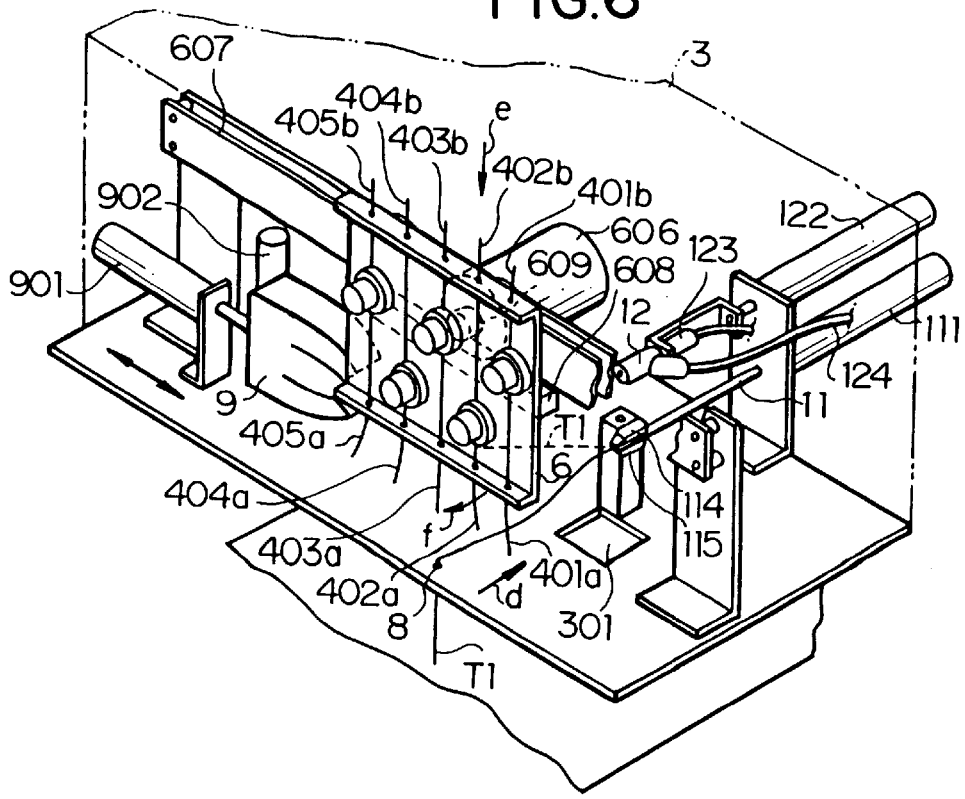
FIG. 6 is a perspective view illustrative of the operation of changing the needle threads of the automatic sewing machine of the invention.

Then, as shown in FIG. 6, the thread pickup 11 is returned to the original position as returning the cylinder 111 with a control signal applied to the solenoid valve SV3, so that the currently using thread T1 is pulled in the direction indicated by an arrow d. At this moment, the changed thread T1 (the thread 403*b*) is fed from the spool in the direction indicated by an arrow e, and is interposed between the arrowhead 113 and the thread retainer 115 and cut by a cooperation of the arrowhead 113 and the thread cutter 114. At this moment, the end portion of the cut thread T1 on the spool side hangs down below the tension bracket 6 while returning in the direction indicated by an arrow f, and the end portion of the cut thread of the needle side is interposed between the thread cutter 114 and the thread retainer 115.

Figure 7:
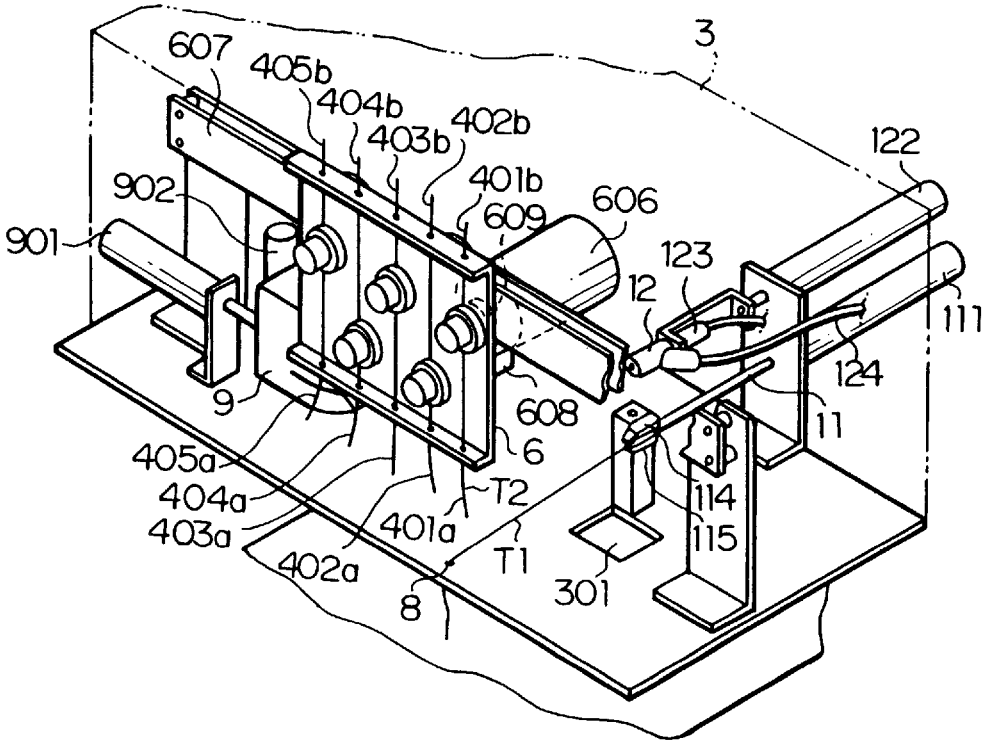
FIG. 7 is a perspective view illustrative of the operation of changing the needle threads of the automatic sewing machine of the invention.

As shown in FIG. 7, in order that the end portion of a changing thread T2 (the thread 401*b* in this example) selected by the thread specification signal hanging down from the tension bracket 6 can position above the hole 8, a control signal is applied to the motor driver 606*a* (see FIG. 3) to drive the motor 606. The tension bracket 6 is horizontally moved over the rail 607 to select the specified thread.

Figure 8:
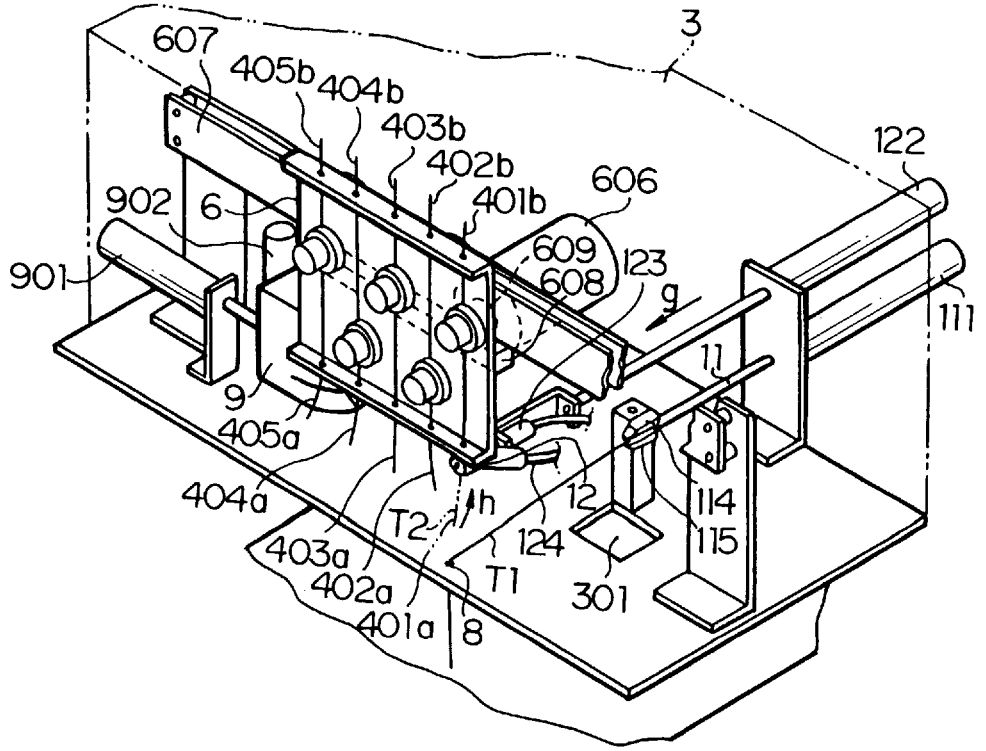
FIG. 8 is a perspective view illustrative of the operation of changing the needle threads of the automatic sewing machine of the invention.

As shown in FIG. 8, a control signal is applied to the solenoid valve SV4 (see FIG. 3), so that the thread clamp 12 is moved in the direction indicated by an arrow g by driving the cylinder 122. As a result, the thread clamp 12 comes close to the end portion of the changing thread T2 (401*b*). A control signal is thereafter applied to the solenoid valve SV6 (see FIG. 3) to thereby cause the thread clamp 12 to suck the end portion of the changing thread T2, and a control signal is applied to the solenoid valve SV5 (see FIG. 3) to thereby drive the cylinder 123 to clamp the end of the changing thread T2 by the clamp section. At the moment, a control signal is applied to the solenoid valve SV5 and sucking of the thread clamp 12 is terminated.

Figure 9:
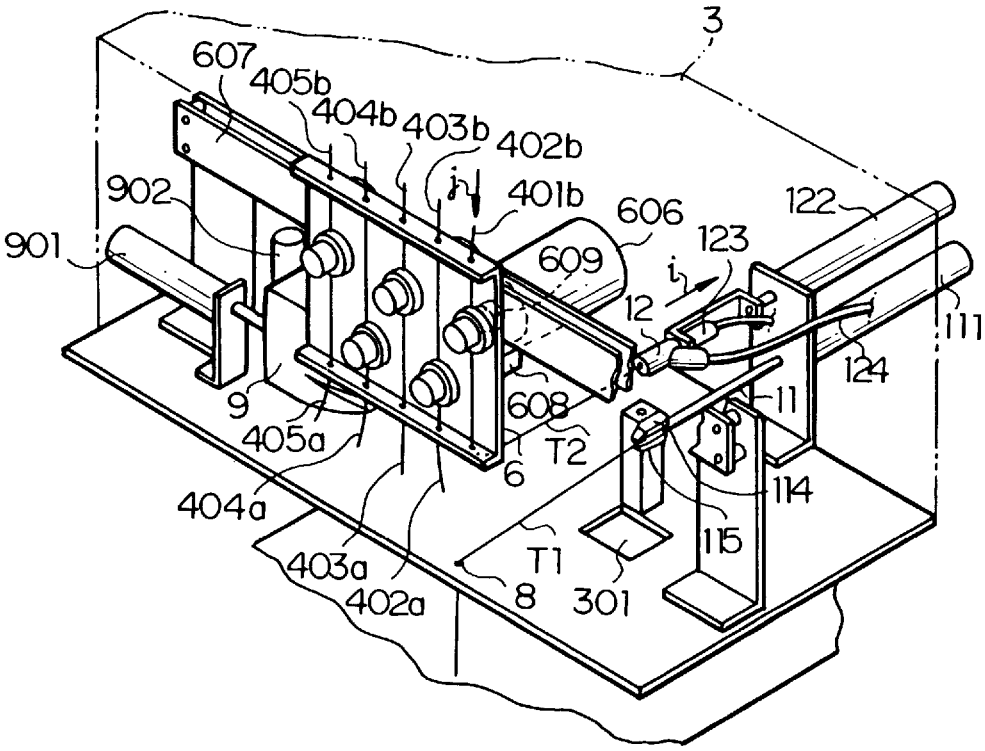
FIG. 9 is a perspective view illustrative of the operation of changing the needle threads of the automatic sewing machine of the invention.

As shown in FIG. 9, a control signal is applied to the solenoid valve SV4 (see FIG. 3), so that the cylinder 122 is driven to return the thread clamp 12 in the direction indicated by an arrow i, and the changing thread T2 is pulled and is fed in the direction indicated by an arrow j. At this moment, the preceding thread T1 and the changing thread T2 are aligned up and drown.

Figure 10:
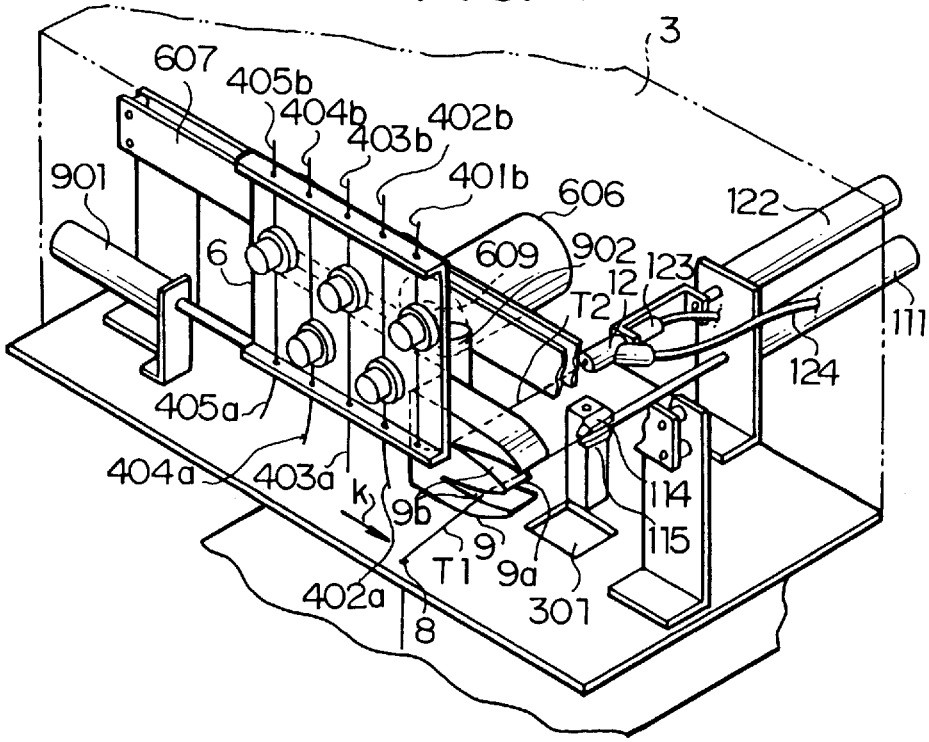
FIG. 10 is a perspective view illustrative of the operation of changing the needle threads of the automatic sewing machine of the invention.

As shown in FIG. 10, a control signal is applied to the solenoid valve SV1 (see FIG. 3), so that the cylinder 901 is driven to move the knotter 9 in the direction indicated by an arrow k and stop at a predetermined position. At that time, the knotter 9 separates the thread T1 and T2 from one another, and guides them to a knotting position along the guide portions 9*a* and 9*b*. Then, a control signal is applied to the solenoid valve SV2 (see FIG. 3), so that the cylinder 902 is detected and the knotter 9 knots the preceding thread T1 with the changing thread T2.

Figure 11:
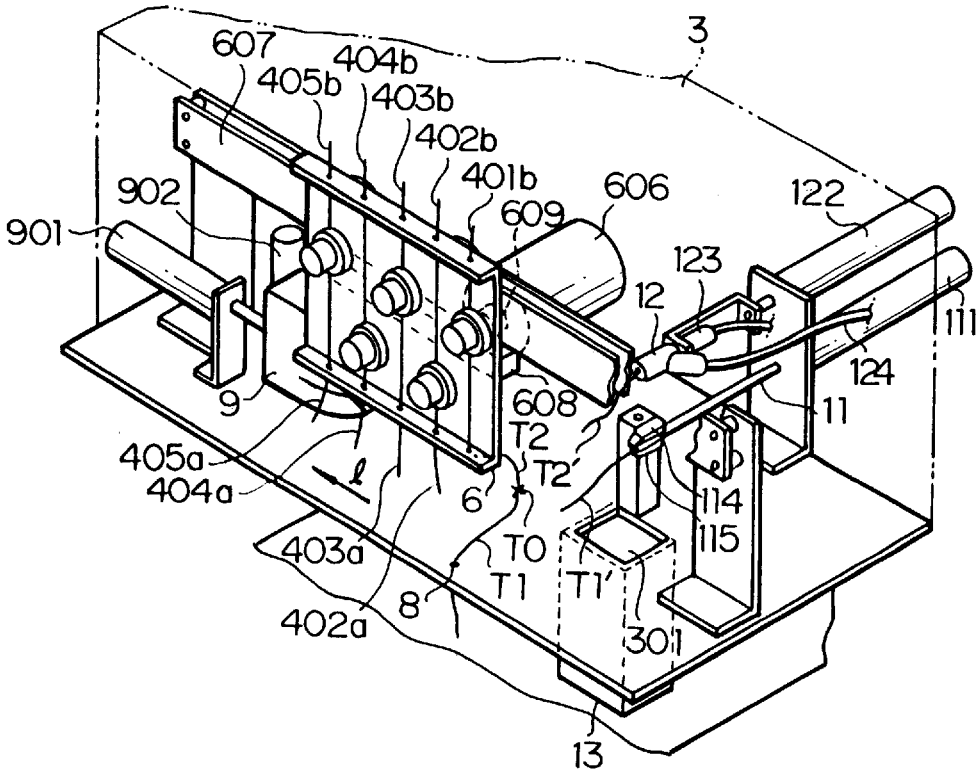
FIG. 11 is a perspective view illustrative of the operation of changing the needle threads of the automatic sewing machine of the invention.
Figure 12:
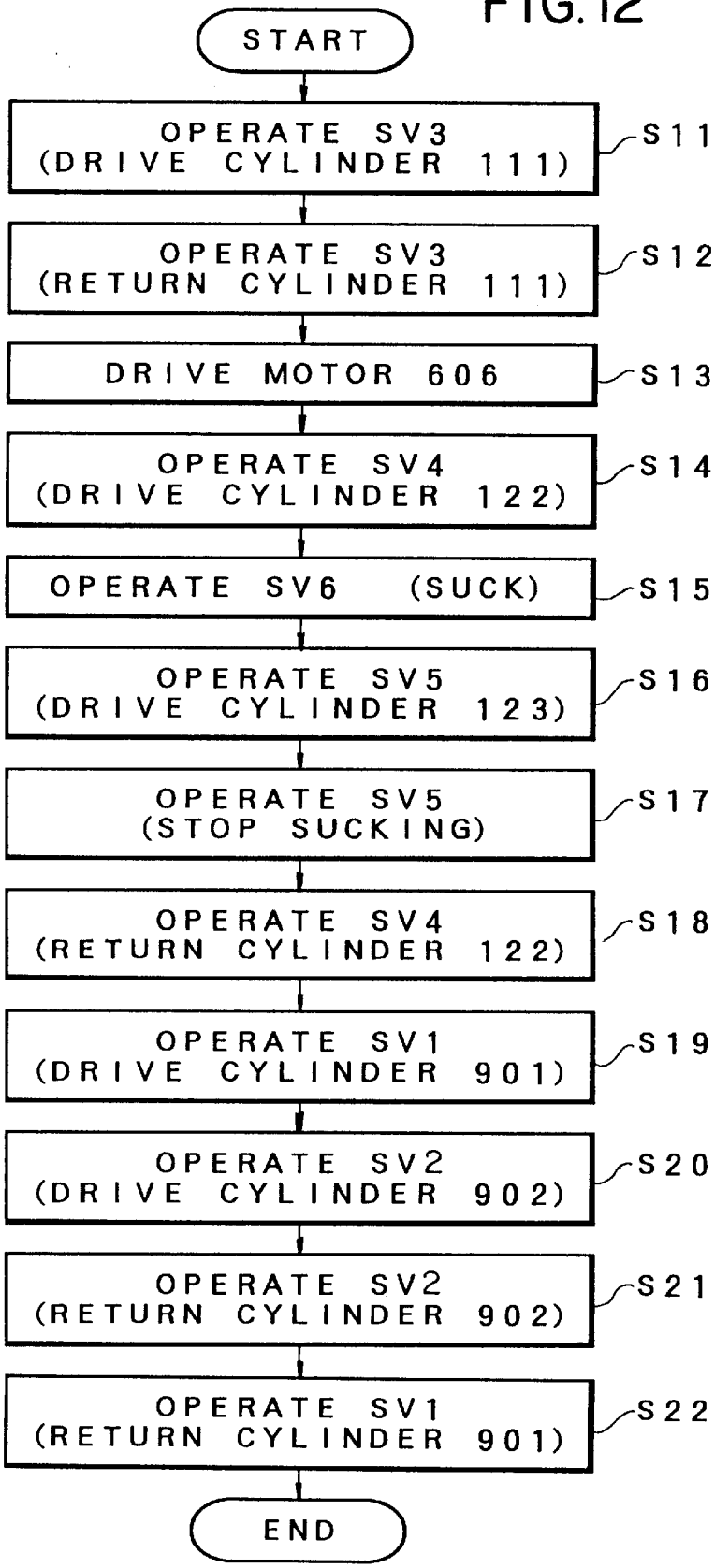
FIG. 12 is a diagram showing a thread changing operation of the invention.

As shown in FIG. 11, a control signal is applied to the solenoid valve SV2 (see FIG. 3) to return the cylinder 902 and to stop the knotting operation by the knotter 9, and a control signal is applied to the solenoid valve SV1 (see FIG. 3) to return the cylinder 901 and to evacuate the knotter 9 in the direction indicated by an arrow l. Thus, the preceding thread T1 and the changing thread T2 are knotted at a knot T0. At the time of a next thread change operation, a remaining portion T1' of the knotted preceding thread drops into the waste thread container 13, and a remaining portion T2' of the knotted changing thread is discharged to a predetermined place while sucked through the valve 124.

According to the automatic sewing machine 1 as described above, the conventionally required operation of moving the spool of a changing thread is no longer performed. That is, a plurality of thread end portions 401*a* to 405*a* respectively drawn from a plurality of spools 401 to 405 are held by the tension bracket 6; a changing thread is selected from these threads held by the tension bracket 6; and the end portion of the selected thread is moved to a knotting position. Compared with the conventional procedure involving the operation of moving the spool itself, the same operation can be performed with a simpler means within a shorter period of time by moving the end portions 401*a* to 405*a* drawn from the respective spools 401 to 405 to a knotting position using the aforementioned automatic sewing machine 1.

Therefore, according to the automatic sewing machine 1, threads can be changed without moving the spools. As a result, the sewing efficiency can be improved, and the structure of the device can be downsized and the cost of manufacture can be reduced.

Further, the tension bracket 6 is designed to hold the end portions 401*a* to 405*a* respectively drawn from a plurality of spools 401 to 405 so as to hang down in a row. Therefore, there is no inconvenience in positioning the thread end portions for knotting even if a thread end portion clamping means is not provided for each holding mechanism that holds a spool as in the conventional example.

Therefore, since the thread end portion clamping means for each spool can be dispensed with, the structure of the device can be downsized and the cost of manufacture can be reduced.

Still further, since the waste thread container 13 into which the remaining thread portion T1' after the threads have been knotted is discharged, as well as the thread clamp 12, the valve 124, and the vacuum generator 125 that discharge the remaining thread portion T2' into a predetermined place are provided, the operation of cleaning up waste threads produced after the threads have been connected can be facilitated.

According to the needle thread changing device of a sewing machine of the first aspect, not only high sewing efficiency can be implemented but also the structure of the device can be downsized and the cost of manufacture can be reduced by allowing threads to be changed without moving spools.

According to the needle thread changing device of a sewing machine of the second aspect, the structure of the device can be downsized and the cost of manufacture can be reduced by dispensing with a thread end portion clamping means for each spool, in addition to the operation and advantages provided by the needle thread changing device of a sewing machine of the first aspect of the invention.

According to the needle thread changing device of a sewing machine of the third aspect, the operation of cleaning the waste threads produced after the threads have been connected can be facilitated, in addition to the operation and advantages provided by the needle thread changing device of a sewing machine of the first or second aspect of the invention.

What is claimed is:

1. A needle thread changing device of a sewing machine, comprising:

a first thread end holding section for holding thread end portions of plurality threads respectively drawn from a plurality of spools;

a thread cutting section for cutting a thread being currently used while selectively drawn from the first thread end holding section;

a second thread end holding section for holding an end portion of the thread of a needle side cut by the thread cutting section;

a thread selecting section for selecting a changing thread from the plurality of threads held by the first thread end holding section;

a thread end portion, moving section for moving an end portion of the thread selected by the thread selecting section to a predetermined knotting position; and a knotting section for connecting the end portion of the thread thus selected to the end portion of the thread currently used held by the second thread end holding section at the knotting position after the thread thus selected has been moved to the predetermined knotting position.

2. The needle thread changing device of a sewing machine according to claim 1, wherein the first thread end holding section holds the thread end portions of the threads so as to hang down in a row.

3. The needle thread changing device of a sewing machine according to claim 1 or 2, further comprising:

a remaining thread discharging section for discharging thread portions remaining after the threads have been connected.

4. A thread changing device comprising;

a sewing machine having a needle;

a plurality of thread winding members, each having a thread;

a first holding member for holding the respective threads in such a manner that the threads respectively paid off from the thread winding members are arranged along thread passages and are maintained so as to be substantially in parallel with one another;

a selecting means for selecting a thread to be fed to the needle while moving the first holding means in a direction perpendicular to the thread passages;

a thread cutting member being arranged closer to the needle than the selecting means along the thread passages and being movable to an operating position and to a return position, the operating position being a position at which the thread cutting member picks up a currently selected thread while crossing the thread passage of the currently selected thread, the return position being a position toward which the thread cutting member moves away from the operating position so that the thread cutting member draws near and cuts the picked up thread and holds an end portion of a cut thread portion extending to the needle;

a pickup member being movable to an operating position and to a return position, the operating position being a position at which the pickup member picks up an end portion of a newly selected thread while crossing the passage of the newly selected thread, the return position being a position at which the pickup member draws near and holds the picked up end portion of the newly selected thread so that the pickup member holds the newly selected thread at a predetermined distance from the currently selected thread held by the thread cutting member with one of the threads up and the other down; and a knotting unit being parallelly movable to an operating position and to a standby position, the operating position being a position at which the knotting unit advances into the distance between the currently selected thread held by the thread cutting member and the newly selected thread held by the pickup member, the standby position being a position toward which the knotting unit moves away from the operating position, the knotting unit also knotting both threads at the operating position.

5. The thread changing device according to claim 4, wherein the thread cutting member and the pickup member are located with one up and the other down, and the thread knotting unit is arranged so as to be distanced therefrom in a horizontal direction.

6. The thread changing device according to claim 4, wherein the moving direction of the selecting means is parallel with the moving directions of the thread knotting unit.

7. The thread changing device according to claim 5, wherein discharge members are arranged below the operating position of the thread cutting member and the operating position of the pickup member, the discharge members serving to scrap cut waste thread portions.

* * * * *